US006776196B2

(12) United States Patent
Yamakawa

(10) Patent No.: US 6,776,196 B2
(45) Date of Patent: Aug. 17, 2004

(54) BRAID FOLDING UNIT AND A BRAID FOLDING METHOD OF A SHIELDED WIRE

(75) Inventor: Nobuaki Yamakawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/083,605

(22) Filed: Feb. 27, 2002

(65) Prior Publication Data

US 2002/0121185 A1 Sep. 5, 2002

(30) Foreign Application Priority Data

Mar. 2, 2001 (JP) ..... 2001-058475

(51) Int. Cl.[7] ..... B21F 15/00
(52) U.S. Cl. ..... 140/71 R; 29/828
(58) Field of Search ..... 29/828, 461, 753; 140/71 R, 107

(56) References Cited

U.S. PATENT DOCUMENTS

| | | | | |
|---|---|---|---|---|
| 3,621,560 A | | 11/1971 | Bright et al. | 29/427 |
| 3,721,138 A | | 3/1973 | Kamimura et al. | 81/9.51 |
| 4,719,697 A | | 1/1988 | Schwartzman et al. | 29/867 |
| 5,595,219 A | * | 1/1997 | Deuel et al. | 140/123 |
| 6,243,947 B1 | * | 6/2001 | Fujita et al. | 29/828 |
| 6,536,103 B1 | * | 3/2003 | Holland et al. | 29/828 |

FOREIGN PATENT DOCUMENTS

| | | |
|---|---|---|
| DE | 40 27 904 | 3/1992 |
| JP | 2000-32626 | 1/2000 |

* cited by examiner

*Primary Examiner*—Lowell A. Larson
(74) *Attorney, Agent, or Firm*—Armstrong, Kratz, Quintos, Hanson & Brooks, LLP

(57) ABSTRACT

A braid folding unit of a shielded wire is provided, which includes: a primary expanding means to beat a braid 22 exposed on an inner cover 24 of the shielded wire 15 so as to outwardly expand the braid; an expanding pipe 135 to enter an inside of the braid 22 along the inner cover so as to further outwardly expand the braid; and a braid folding member 137 to advance along an outside surface of the expanding pipe so as to push the braid 22 in an axial direction of the shielded wire and to fold back the braid. The primary expanding means has a pair of openable-and-closable expanding teeth 134, a pair of sliding members fixing the respective expanding teeth, and a driving means to open and close the pair of sliding members in opposite directions.

2 Claims, 4 Drawing Sheets

15

15
19a
19
19b 15
19
21
20

15
19
20
22

15
19
22
24
19b 15
19
22
24

15
19
23
19b
24

15
19
23
24

15
19
23
24
25

15
19
23
24
26
27

BRAID FOLDING UNIT AND A BRAID FOLDING METHOD OF A SHIELDED WIRE

BACKGROUND OF THE INVENTION

1. Field of the Invention

The present invention relates to a braid folding unit and a braid folding method of a shielded wire, wherein a braid of a relatively large-diameter shielded wire used for an electric vehicle and the like can be automatically efficiently folded back toward a shield contactor.

2. Description of the Related Art

The following processing of a shielded wire has been conventionally carried out by hand. That is, a sheath (outer cover), having been cut off in a determined length, of an end portion of the shielded wire is stripped using a device so as to expose a braid made of conductive metal, the braid is cut with scissors in a determined length, a shield contactor made of conductive metal is applied over the wire by hand and positioned behind the braid, and the braid is folded back toward the shield contactor. Further, a shield pipe made of conductive metal is applied over the wire by hand, and the shield pipe is crimped by a crimping device in a state that the braid is put between the shield contactor and the shield pipe. (Refer to FIG. 3 with respect to the form of the braid, the shield contactor, the shield pipe and so on.) Subsequently, an inner cover of the end portion of the wire is stripped using a device, and a terminal is connected to a core wire by a pressure-welding device.

As for the shielded wire, a connecting flange is fitted to the shield pipe, and the connecting flange is grounded to a vehicle body. The terminal is connected to a motor, an inverter or a battery of the electric vehicle.

With respect to the above prior folding method of the shielded wire, however, a worker folds back the braid by using a center punching in a sharp pin-like shape, which requires much man-hour and manufacturing costs and causes dispersion of the folding angle. And, when the folding angle is small, the next step of applying the shield pipe would not be carried out well.

SUMMARY OF THE INVENTION

In view of the foregoing, an object of the present invention is to provide a braid folding unit and a braid folding method of a shielded wire, wherein a braid of a relatively large-diameter shielded wire used for an electric vehicle and the like can be automatically efficiently folded back toward a shield contactor.

In order to achieve the above object, as a first aspect of the present invention, a braid folding unit of a shielded wire comprises: a primary expanding means to beat a braid exposed on an inner cover of the shielded wire so as to outwardly expand the braid; an expanding pipe to enter an inside of the braid along the inner cover so as to further outwardly expand the braid; and a braid folding member to advance along an outside surface of the expanding pipe so as to push the braid in an axial direction of the shielded wire and to fold back the braid.

According to the above structure, because the braid can be expanded large by two means of the braid primary expanding means and the expanding pipe, the folding of the braid by the braid folding member can be carried out without dispersion of the folding angle. By this, the fitting of the shield pipe on the folded braid at the next step can be securely carried out, thereby improving the product quality.

And, because the opening operation and the folding operation are sequentially automatically carried out, man-hours required for folding the braid and the manufacturing cost can be reduced.

As a second aspect of the present invention, based on the first aspect, the primary expanding means has a pair of openable-and-closable expanding teeth, a pair of sliding members fixing the respective expanding teeth, and a driving means to open and close the pair of sliding members in opposite directions.

According to the above structure, a pair of sliders open or close integrally with the respective expanding teeth by a driving means and the braid of the shielded wire is repeatedly pressed by the expanding teeth, thereby expanding the braid in a bell-like shape. By this, an insertion of the expanding pipe into the braid can be securely carried out, thereby preventing the end of the expanding pipe from bending the braid inward.

As a third aspect of the present invention, a braid folding method of a shielded wire comprises the steps of: beating a braid exposed on an inner cover of the shielded wire by a primary expanding means so as to outwardly expand the braid; entering an expanding pipe into an inside of the braid along the inner cover so as to further outwardly expand the braid by an end sloping portion of the expanding pipe; and advancing a braid folding member along an outside surface of the expanding pipe so as to push the braid in an axial direction of the shielded wire and to fold back the braid.

According to the above structure, because the braid can be expanded large by two means of the braid primary expanding means and the expanding pipe, the folding of the braid by the braid folding member can be carried out without dispersion of the folding angle. By this, the fitting of the shield pipe on the folded braid at the next step can be securely carried out, thereby improving the product quality. And, because the opening operation and the folding operation are sequentially automatically carried out, man-hours required for folding the braid and the manufacturing cost can be reduced.

The above and other objects and features of the present invention will become more apparent from the following description taken in conjunction with the accompanying drawings.

DESCRIPTION OF THE PREFERRED EMBODIMENT(S)

Figure 1:
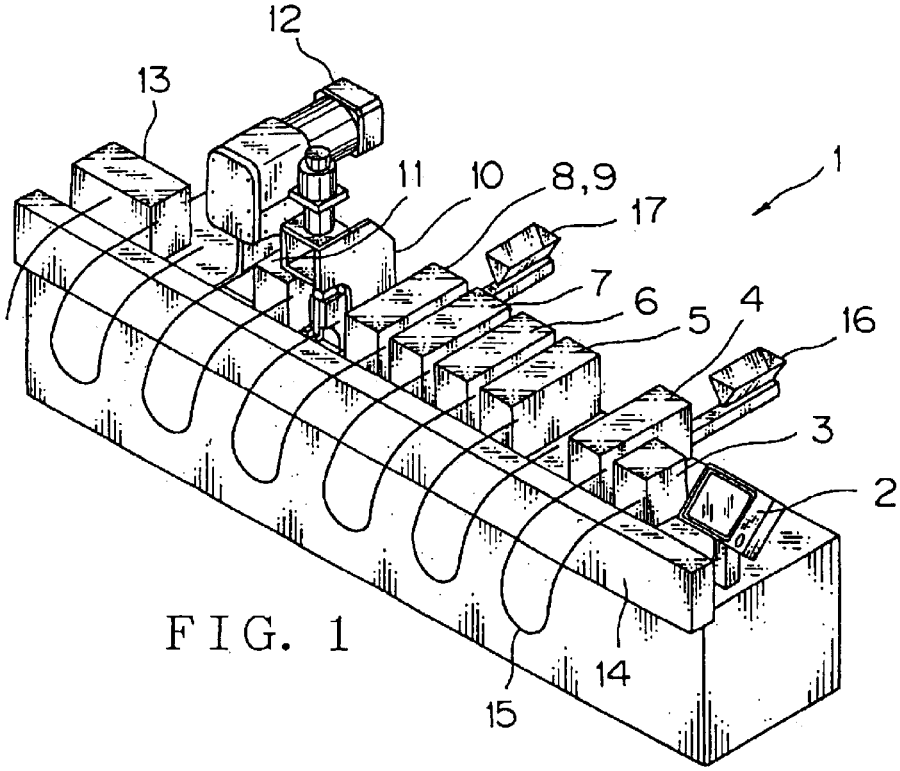
FIG. 1 is a perspective view showing an embodiment of a shielded wire processing apparatus including the inventive braid folding unit of a shielded wire.

Embodiment(s) of the present invention will now be described in further detail with reference to the accompanying drawings. FIG. 1 is a perspective view showing an embodiment of a shielded wire processing apparatus including the inventive braid folding unit of a shielded wire.

This shielded wire processing apparatus 1 has, successively from the right, a console 2 to change the article number, automatic/manual operation and so on, a wire setting unit 3, a shield contactor insertion unit 4, a sheath cutting unit 5, a sheath pulling out unit 6, a braid cutting unit 7, a braid folding unit 8, a shielding pipe inserting unit 9, a shield pipe crimping unit 10, a stripping unit 11, a terminal crimping unit 12, a product picking-off unit 13, and a carrying unit 14 to shift the shielded wire 15 along the units 3–13. A unit carrying out the braid folding and the shield pipe insertion is adopted in FIG. 1, but the braid folding unit 8 and the shielding pipe inserting unit 9 may be arranged in parallel. The units 3–13 are arranged in parallel with almost the same intervals.

In FIG. 1, reference 16 denotes a hopper for feeding the shield contactor, and 17 denotes another hopper for feeding the shield pipe. The shielded wire 15 can be thick up to a cross section of about 15 $mm^2$, which shielded wire 15 is set on the wire setting unit 3 in a U-bent state or a straight state.

Figures 2A, 2B, 2C, 2D, 2E, 2F, 2G, 2H, 2I, 2J:
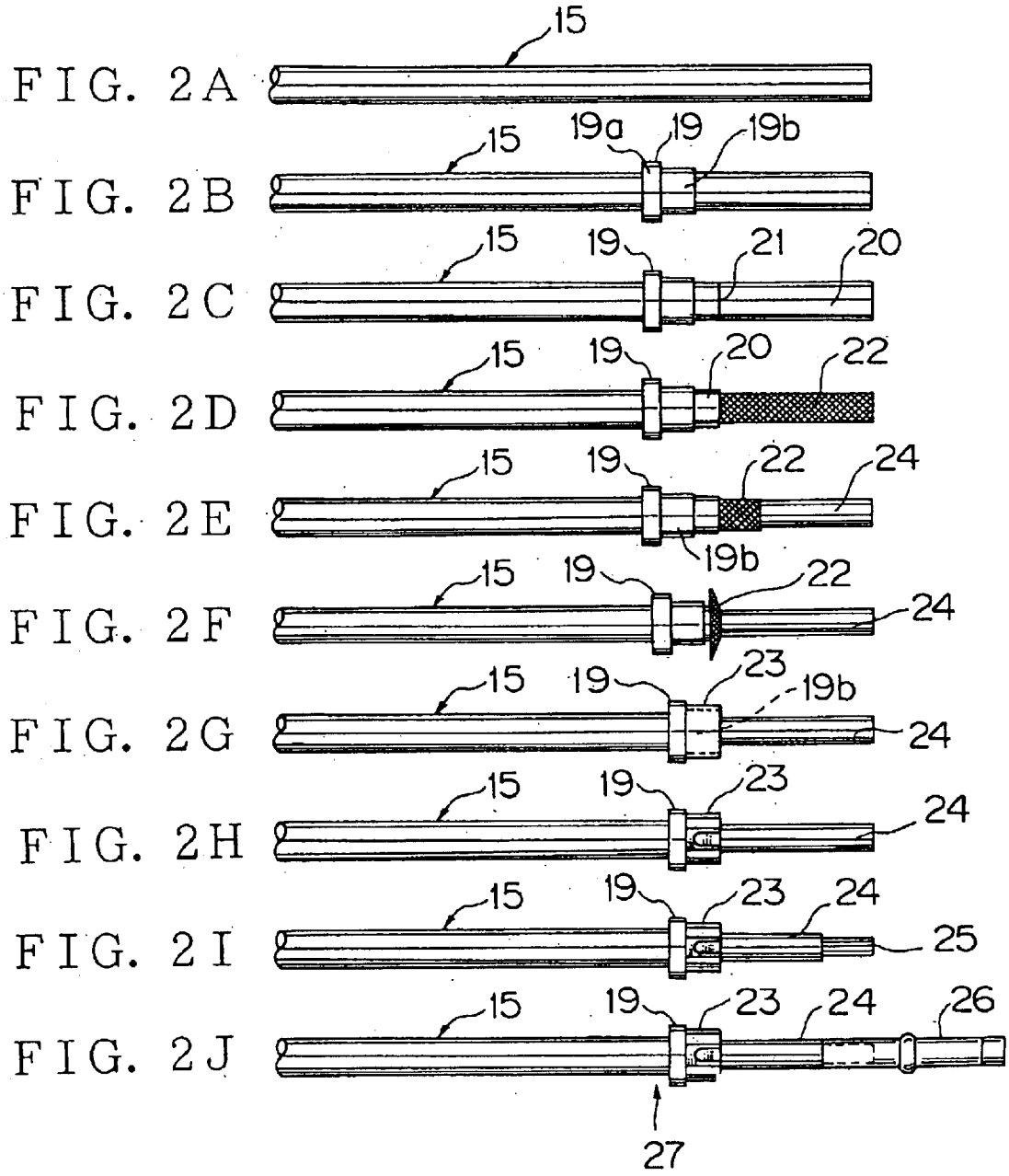
FIGS. 2A–2J are plan views sequentially showing the work process of the shielded wire by using the shielded wire processing apparatus.

The shielded wire processing method and the action using the shielded wire processing apparatus 1 are described using FIGS. 1 and 2 hereinafter. First, an operator sets the shielded wire 15 cut off in a determined length in advance as shown in FIG. 2A on the wire setting unit 3 of FIG. 1. Only the setting of the wire has to be carried out by an operator. On setting the shielded wire 15, the wire carrying unit 14 moves to the left by one pitch so as to send the shielded wire 15 to the shield contactor insertion unit 4.

Figure 3:
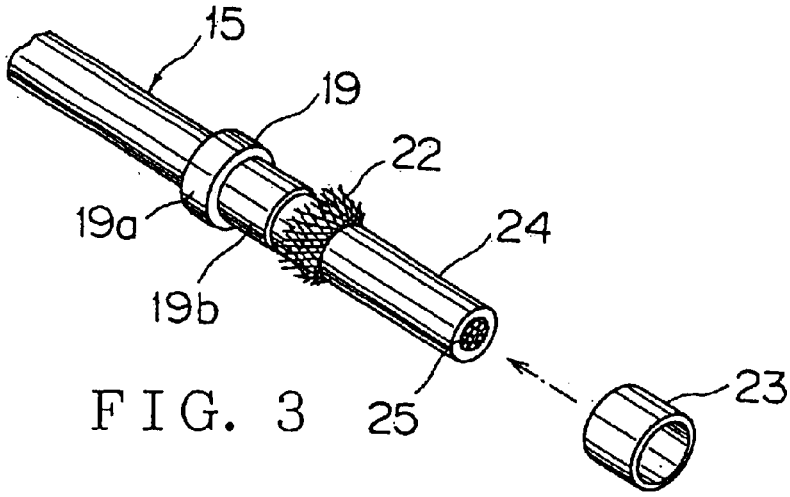
FIG. 3 is an exploded perspective view showing a halfway state (a state of the braid being folded back) of the work process of the shielded wire.

The circular shield contactor 19 made of conductive metal is fitted on the shielded wire 15 by the shield contactor insertion unit 4 as shown in FIG. 2B. As also shown in FIG. 3, the shield contactor 19 consists of a large-diameter collar portion 19*a* and a small-diameter tube portion 19*b*. The shielded wire 15 having the shield contactor 19 is sent to the next sheath cutting unit 5 of the carrying unit 14. As shown in FIG. 2C, at a determined position nearer the end side of the wire than the shield contactor 19 as shown in FIG. 2C, a cut 21 is provided circularly on an insulative sheath (outer cover) 20 of the shielded wire 15.

Subsequently, the shielded wire 15 is sent to the sheath pulling out unit 6, and the outer cover 20 is pulled out as shown in FIG. 2D, whereby an inside metal braid 22 is exposed by the determined length. The braid 22 is made up of conductive thin metal wires braided crossingly as shown in FIG. 3. Subsequently, the shielded wire 15 is sent to the inventive braid cutting unit 7, and the braid 22 exposed as shown in FIG. 2E is cut off in the determined length, whereby an insulative inner cover 24 is exposed.

Subsequently, the shielded wire 15 is sent to the inventive braid folding unit 8, and the braid 22, as shown in FIG. 2F, is folded back toward the small-diameter tube portion 19*b* of the shield contactor 19. Then, a circular shield pipe 23 made of conductive metal is fitted on the shielded wire 15 from the end thereof by the shielding pipe inserting unit 9 as shown in FIGS. 2G and 3. The braid 22 is put between the inner surface of the shield pipe 23 and the outer surface of the tube portion 19*b* of the shield contactor 19 at a longitudinal determined position of the shielded wire 15. A folding angle of the braid 22 is between 90° and 180°.

Subsequently, the shielded wire 15 is sent to the shield pipe crimping unit 10, the shield pipe 23 is crimped hexagonally so as to be fastened to the shield contactor 19 as shown in FIG. 2H. Because the braid 22 is put between the shield contactor 19 and the shield pipe 23, the shield pipe 23 and the shield contactor 19 are tightly fastened to the shielded wire 15.

Subsequently, the shielded wire 15 is sent to the stripping unit 11, the end side of the inner cover 24 of the shielded wire 15 is stripped by a determined length as shown in FIG. 2I, whereby the core wire (i.e. conductor portion) 25 is exposed. Subsequently, the shielded wire 15 is sent to the terminal crimping unit 12, the terminal 26 is crimped to the exposed core wire 25 as shown in FIG. 2J. Finally, a product 27 is transferred from the processing apparatus 1 to an external pallet (not shown) by a product picking-off unit 13. Here, the terminal crimping unit 12 may be separated from the shielded wire processing apparatus 1.

Figure 4:
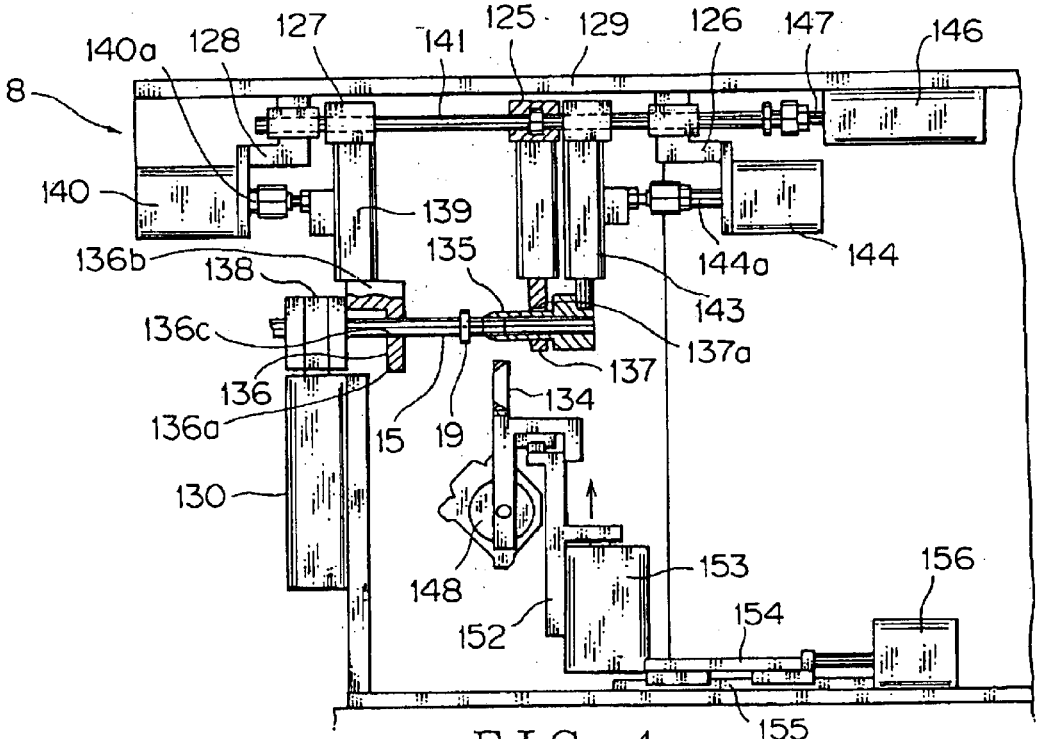
FIG. 4 is a side view showing an embodiment of the inventive braid folding unit of the shielded wire.
Figure 5:
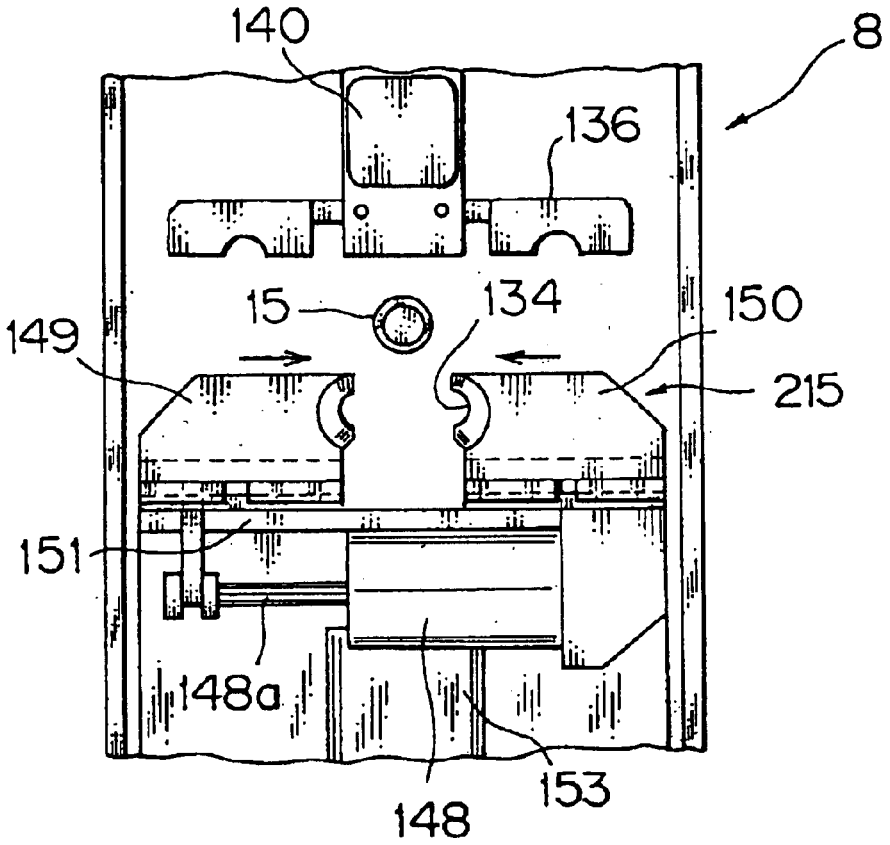
FIG. 5 is a front view mainly showing a braid expanding means of the braid folding unit.

Hereinafter, referring to FIGS. 4–6, an embodiment of the inventive braid folding unit and method are described. In FIGS. 4 and 5, reference 134 is a braid expanding tooth, 135 is a braid expanding pipe, 19 is the shield contactor, 136 is a contactor pusher, and 137 is a braid folding member.

In FIG. 4, the wire 15 is held at the middle portion thereof by a chuck 138, is supported ahead of the middle portion by the contactor pusher 136, and is supported at the end portion thereof by the expanding pipe 135. The contactor pusher 136 consists of a right and left pair of chucks, which do not hold, but support, the wire 15, is opened or closed by a vertically installed air-operated opening-closing cylinder (opening-closing means) 139, and is movable forward and backward along a guide shaft (a guiding means) 141 of a horizontally installed air-operated cylinder (a driving means) 140. The contactor pusher 136 acts as a wire aligning (or positioning) member.

The chuck 138 is horizontally opened by an air-operated chuck cylinder 130. Behind the chuck 138, another chuck (not shown) of the carrying unit 14 (FIG. 1) is positioned. The contactor pusher 136 consists of a plate portion 136*a* being vertical and an upper base portion 136*b* being horizontal and is formed in a generally L-shape. A wire support hole 136*c* is formed on the vertical plate portion 136*a*. A bore diameter of the wire support hole 136*c* is smaller than the outside diameter of a collar portion 19*a* (FIG. 3) of the shield contactor 19. The front surface of the plate portion 136*a* is abuttable on the rear end surface of the collar portion 19*a* of the shield contactor 19. Here, the front side in this specification is defined as the end side of the wire 15.

The base portion 136*b* is connected with the opening-closing cylinder 139 at a rearward position so as not to interfere with the shield contactor 19. The opening-closing cylinder 139 is connected to a rod 140*a* of a rear horizontal cylinder 140 through a joint member. The cylinder 140 is fixed to an upper horizontal frame baseplate 129 by a bracket 128. The cylinder 139 slidably engages a guide shaft 141 by an upper bearing 127.

Figure 6:
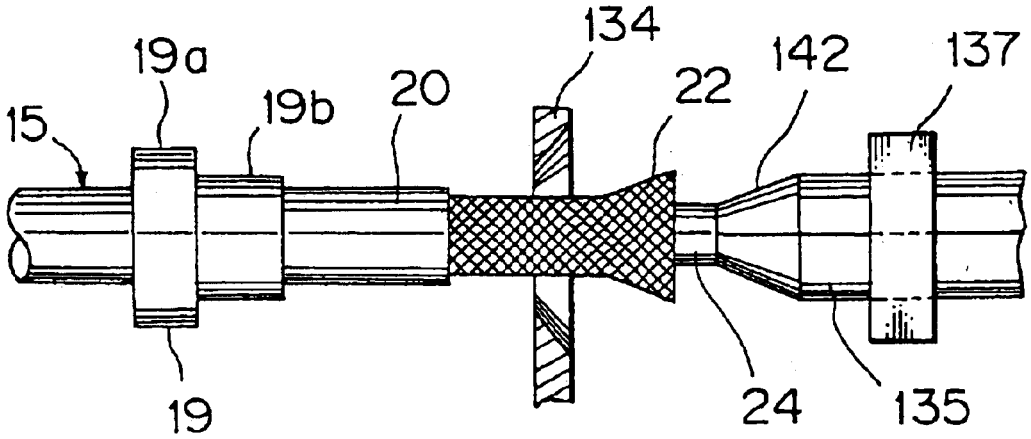
FIG. 6 is a partly sectional plan view showing a main portion (a portion of folding back the braid) of the braid folding unit.

The braid expanding pipe 135 shown in FIG. 6 (a plan view) can be separated right and left and has a tapered slanting surface 142 at the end portion. The bore diameter of the expanding pipe 135 is a little large than the outside diameter of the inner cover of the shielded wire. The outside diameter of the expanding pipe 135 is desirably not less than the outside diameter of the tube portion 19*b* of the shield contactor 19.

The expanding pipe 135 is connected to the air-operated opening-closing cylinder 143 (an opening-closing means) (FIG. 4) and is openable-and-closable. The opening-closing cylinder 143 slidably engages an upper horizontal guide shaft 141 through a bearing and is connected with a rod 144*a* of a horizontal air-operated cylinder (a driving means) 144 through a joint member so as to be movable in a wire's longitudinal direction. The cylinder 144 is fixed to the upper frame baseplate 129 through the front bracket 126. The braid folding member 137 is arranged slidably in the wire longitudinal direction with a gap to the outside of the expanding pipe 135.

The braid folding member 137 is provided with a circular hole 137*a* on its vertical plate portion, which circular hole 137*a* can be symmetrically separated right and left. The braid folding member 137 is openably-and-closably connected to the opening-closing cylinder (an opening-closing means) 143 like a pair of chucks. The bore diameter of the circular hole 137*a* is almost equal to, or a little larger than, the outside diameter of the tube portion 19*b* of the shield contactor 19.

The opening-closing cylinder 143 is connected to the horizontal guide shaft 141 by an upper bearing 125. The guide shaft 141 also acts as a drive shaft. A drive shaft may be arranged in parallel with the guide shaft 141. The drive shaft 141 (the same reference as that of the guide shaft 141 being used) is connected with a rod 147 of a horizontal air-operated cylinder (a driving means) 146 and is movable in the wire longitudinal direction. The cylinder 146 may be replace with a motor (not shown), the guide shaft 141 may be replace with a ball screw shaft (not shown), and the bearing 125 may be replace with a nut portion (not shown).

In FIG. 4, a right and left pair of braid expanding teeth 134 are positioned under the wire 15. In FIG. 5, a braid primary expanding means 215 is shown. The right and left expanding teeth 134 are connected with a rod 148*a* of a horizontal floating air-operated cylinder (a driving means) 148 and a cylinder body (148 being also assigned), respectively, through respective sliding members 149,150 and a horizontal rail 151. The right and left expanding teeth 134 are openable-and-closable in a wire's lateral direction by virtue of the cylinder 148.

The expanding teeth 134 and the cylinder 148 are connected with a rod of a vertical air-operated cylinder (a driving means) 153 as shown in FIG. 4 and are vertically movable. The vertical air cylinder 153 is fixed to the lower horizontal baseplate 154. The baseplate 154 slidably engages a horizontal guide rail (a guiding means) 155 and is movable in the wire longitudinal direction by a horizontal air-operated cylinder (a driving means) 156. The expanding tooth 134 is semicircular and has a wedge being not so sharp.

Referring to FIG. 4, the expanding teeth 134 are lifted by means of the cylinder 153 in their opened state by means of the cylinder 148. The braid 22 of the wire is positioned between the pair of expanding teeth 134. As shown in FIG. 6 (a plan view), the expanding teeth 134 push the braid 22 toward the inner cover 24 repeatedly so as to expand the braid 22 in a bell-like shape.

By virtue of the cylinder 148 as a driving means, the braid 22 of the shielded wire 15 can be repeatedly pressed by the expanding teeth 134 with an appropriate force, whereby the braid 22 can be securely opened in a bell-like shape without any damage.

Subsequently, the inner cover 24 is covered, but not held, by the expanding pipe 135 by closing the expanding pipe 135 by means of the opening-closing cylinder 143. The expanding pipe 135 is advanced toward the braid 22 so that the slanting surface 142 pushes an inner surface of the bell-like shaped portion of the braid 22 thereby to further expand the braid 22 outward. Here, by opening the expanding pipe 135 right and left by the cylinder 143, the braid 22 can be further expanded outward. In this case, the folding member 137 has to be apart from the expanding pipe 135.

The shield contactor 19 is pushed at the rear surface of the collar portion 19*a* by the pushing member 136 by virtue of the cylinder 140 and moves up to the front end position of the outer cover 20. The folding member 137 advances along the expanding pipe 135 by virtue of the cylinder 146 so that the braid 22 is folded back over the outer surface of the tube portion 19*b* of the contactor 19. At this time, the expanding teeth 134 is in an opened state by virtue of the cylinder 148 and also is at the lower position by virtue of the cylinder 153. The expanding teeth 134 can change its position in the wire longitudinal direction by virtue of the horizontal cylinder 156 on the frame.

Figure 7:
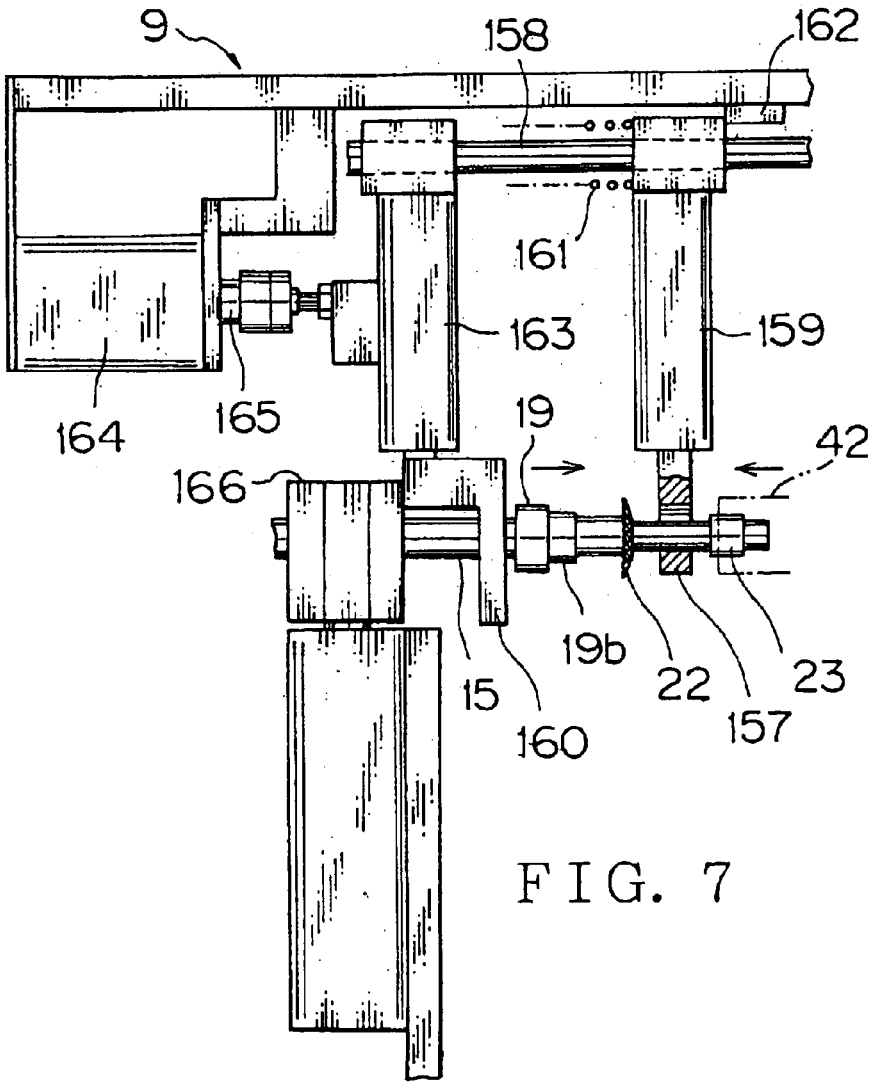
FIG. 7 is a side view showing a main portion of a shielding pipe inserting unit.

The wire 15 with the braid 22 having been folded back is then sent to the next shielding pipe inserting unit 9 by the carrying unit 14. The outline of the shielding pipe inserting unit 9 is shown in FIG. 7. The shield pipe 23 is a circular member and is fitted on the folded braid 22 on the tube portion 19*b* of the shield contactor 19 so as to secure the braid 22 to the shield contactor 19.

As shown in FIG. 7, the shield pipe 23 is fitted on the wire 15 from its end by an axial movement of a parts transferring portion 42 driven by a cylinder (not shown). On this occasion, the end portion of the wire 15 is supported by the supporting member 157 of an openable-closable chuck type and is aligned. The parts transferring portion 42 pushes the supporting member 157 along a guide shaft 158 in the wire longitudinal direction and fits the shield pipe 23 on the wire 15. At this time, the supporting member 157 evades by separating right and left by virtue of the opening-closing cylinder 159.

The shield contactor 19 is pushed by the pushing member 160 of a chuck-type until the shield contactor 19 is put into contact with the braid 22, and the parts transferring portion 42 advances so as to fit the shield pipe 23 on the braid 22. The braid 22 is further folded backward on the tube portion 19*b* of the shield contactor 19.

The opening-closing cylinder 159 of the supporting member 157 is energized toward the parts transferring portion 42 by a coil spring (an energization member) 161 and is stopped while abutting against a stopper 162. The pushing member 160 is opened or closed by the opening-closing cylinder 163. The opening-closing cylinder 163 slidably engages the horizontal guide shaft 158 and is connected with the rod 165 of the horizontal air cylinder 164 movably in the wire longitudinal direction.

The pushing member 160 advances along the wire 15 by virtue of the cylinder 164 and positions the shield contactor 19 behind the folded braid 22. The pushing member 160 is openable-and-closable and only supports, does not hold, the wire 15. The aligning of the wire 15 is securely carried out by the pushing member 160 so that the shield pipe 23 can be securely fitted on the folded braid. The wire 15 is held by the chuck 166 behind the pushing member 160.

Here, the pushing member 136 of FIG. 4 may substitute for the pushing member 136 of FIG. 4, the cylinder 139 of FIG. 4 may substitute for the chuck 166 of FIG. 7, and the chuck 138 of FIG. 4 may substitute for the chuck 166 of FIG. 7.

When the shield contactor 19 with a generally triangle collar portion (not shown) is used, the collar portion is set in a state that a peak of the collar portion is positioned downward and a right and left pair of positioning pins (not shown) are provided on the front surface of the contactor pusher member 136 so that the collar portion can be predeterminedly directed by putting the collar portion between the pines.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A shielded wire processing apparatus, comprising:

a wire carrying unit;

a braid folding unit, comprising:

a primary expanding means to beat a braid exposed on an inner cover of shielded wire so as to outwardly expand the braid;

an expanding pipe to enter an inside of the braid along the inner cover so as to further outwardly expand the braid; and a braid folding member to advance along an outside surface of the expanding pipe so as to push the braid in an axial direction of the shielded wire and to fold back the braid, wherein the primary expanding means has a pair of openable-and-closable expanding teeth, a pair of sliding members fixing the respective expanding teeth, and a driving means to open and close the pair of sliding members in opposite wire lateral directions; and a shielding pipe inserting unit fitting a shield pipe on the folded braid to secure the folded braid, wherein the wire carrying unit carries the shielded wire from the braid folding unit to the shielding pipe inserting unit.

2. A braid folding method of a shielded wire, comprising the steps of:

beating a braid exposed on an inner cover of the shielded wire by a primary expanding means so as to outwardly expand the braid;

entering an expanding pipe into an inside of the braid along the inner cover so as to further outwardly expand the braid by an end sloping portion of the expanding pipe;

advancing a braid folding member along an outside surface of the expanding pipe so as to push the braid in an axial direction of the shielded wire and to fold back the braid; and supporting an end portion of the shielded wire by a supporting member;

pushing the supporting member along a guide shaft in a wire longitudinal direction and fitting a shield pipe on the folded braid so as to secure the folded braid, the pushing and fitting being performed by axial movement of a parts transferring portion, wherein the primary expanding means has a pair of openable-and-closable expanding teeth, a pair of sliding members fixing the respective expanding teeth, and a driving means to open and close the pair of sliding members in opposite wire lateral directions.

* * * * *